US006121506A

United States Patent [19]

Abel et al.

[11] Patent Number: 6,121,506

[45] Date of Patent: Sep. 19, 2000

[54] METHOD FOR DESTROYING ENERGETIC MATERIALS

[75] Inventors: Albert E. Abel, Powell; Robert W. Mouk, Westerville; Gerry D. Getman, Marengo, all of Ohio; Wood E. Hunter, The Woodlands, Tex.

[73] Assignee: Commodore Applied Technologies, Inc., New York, N.Y.

[21] Appl. No.: 09/329,533

[22] Filed: Jun. 10, 1999

Related U.S. Application Data

[63] Continuation of application No. PCT/US97/22731, Dec. 8, 1997.

[60] Provisional application No. 60/035,261, Dec. 12, 1996.

[51] Int. Cl.[7] ..... A62D 3/00

[52] U.S. Cl. ..... 588/200; 588/202; 588/203; 588/205; 149/124; 570/262

[58] Field of Search ..... 588/200, 202, 588/203, 205; 149/124; 570/262

[56] References Cited

U.S. PATENT DOCUMENTS

| | | | |
|---|---|---|---|
| Re. 34,419 | 10/1993 | Melvin et al. | 149/109.6 |
| 4,793,937 | 12/1988 | Meenan et al. | 210/771 |
| 4,853,040 | 8/1989 | Mazur et al. | 134/2 |
| 5,100,477 | 3/1992 | Chromecek et al. | 134/7 |
| 5,110,364 | 5/1992 | Mazur et al. | 134/2 |
| 5,387,717 | 2/1995 | Puckett et al. | 564/295 |
| 5,430,229 | 7/1995 | Voss | 588/202 |
| 5,495,062 | 2/1996 | Abel | 588/1 |
| 5,514,352 | 5/1996 | Hanna et al. | 422/225 |
| 5,523,517 | 6/1996 | Cannizzo et al. | 588/203 |
| 5,613,238 | 3/1997 | Mouk et al. | 588/1 |

FOREIGN PATENT DOCUMENTS 299 705 A7 5/1992 German Dem. Rep. .

*Primary Examiner*—Gary P. Straub
*Assistant Examiner*—Melanie C. Wong
*Attorney, Agent, or Firm*—Howard M. Ellis; Marianne Fuierer

[57] ABSTRACT

Energetic materials, such as nitrocellulose, TNT, RDX, and combinations thereof, optionally in combination with chemical warfare agents, such as mustard gas, Lewisite, Tabun, Sarin, Toman, VX, and combinations thereof, are destroyed when chemically reacted according to the method of the invention. The method comprises reacting the energetic materials and chemical warfare agents, of present, with solvated electrons which are preferably produced by dissolving an active metal such as sodium in a nitrogenous base such as anhydrous liquid ammonia.

23 Claims, 1 Drawing Sheet

METHOD FOR DESTROYING ENERGETIC MATERIALS

CROSS REFERENCE TO RELATED APPLICATION

This application is a continuation of as PCT/US97/22731 on Dec. 8, 1997, which claims priority under U.S. Provisional Application 60/035,261, filed Dec. 12, 1996.

TECHNICAL FIELD

This invention is in the field of energetic materials contained in explosives, propellants and pyrotechnics. More specifically, the invention provides a chemical method for destroying such energetic materials by utilizing nitrogenous base in combination with active metal, providing a powerful dissolving metal reduction featuring solvated electrons.

BACKGROUND ART

In recent years a number of international treaties and agreements have committed nations around the world to reduce their weapons arsenals. For example, in January 1993, representatives from more than 130 nations signed the final draft of the Chemical Weapons Convention, which outlaws the production, use, sale, and stockpiling of all chemical weapons and their means of delivery and calls for the destruction of existing stocks by the year 2005. In 1993, some 20 nations were suspected of possessing chemical arsenals or having the means to make them.

A patent application, in the name of the assignee of the instant application, has been filed under the Patent Cooperation Treaty and discloses a chemical method and apparatus for destroying chemical warfare agents ("CWA's" hereinafter); that is, application PCT/US96/16303, filed Oct. 10, 1996 and incorporated herein by reference. That method utilizes nitrogenous base, optionally with active metal, in a dissolving metal reduction.

In most cases CWA's are stored in munitions that also contain energetic materials ("EM's" hereinafter). The U.S. Army's M-55 rocket, a chemical warfare weapon, is an example. In this weapon, leakage of the nerve agent "Sarin" or "GB" into the burster charge has already been observed, and it has been noted that the rocket's propellant is also becoming unstable. The "M-28" propellant in the M-55 rocket is a mixture of nitrocellulose, trinitroglycerine, binders, and stabilizers. The burster charge, which disperses the nerve agent upon rocket impact, is an explosive mixture comprising trinitrotoluene ("TNT") and cyclomethylenetrinitramine ("RDX"), otherwise known as "Composition B."

Whereas, a means for destroying the CWA's was provided in the referenced earlier application, a serious problem remains; namely, it remains to provide a method for demilitarizing the explosives and/or propellants used to deliver the CWA's to their targets and disperse the CWA's once the targets are reached.

The instant application addresses this outstanding problem by providing a method for destroying the EM's incorporated into the explosives and/or propellants used as delivery means for the CWA's. With considerable surprise, applicants have found, quite unexpectedly, that the method earlier disclosed to substantially destroy the CWA's can also be employed to substantially destroy the EM's contained in the delivery means which accompany the CWA's. This serendipitous discovery not only greatly simplifies the destruction of the complete package of hazardous substances accompanying and including the CWA's, but also provides an attractive method for destroying EM's outside the CWA context as well. Aside from the CWA context, EM's are employed by military and civilian organizations, as well as individuals, in weapons of various kinds, including the small arms ammunition used by hunters, as well as in various blasting operations, including mining, and so forth. In another context, EM's appear as soil contaminants at a number of hazardous materials sites, and the method of this invention can often be advantageously employed in the remediation of those sites.

EM's are components in three classes of products, namely, explosives, propellants, and pyrotechnics; see, for example, Department of the Army Technical Manual TM 9-1300-214, "*Military Explosives,*" Headquarters, Dept. of the Army, 1984 and the manual provided at "*An Introduction to Explosives,*" presented at the FAA's Energetic Materials Workshop, Avalon, N.J., Apr. 14–17, 1992. The EM's in explosives and propellants, when chemical reaction is properly initiated, generate large volumes of hot gases in a short time, the primary difference between propellants and explosives being the rate at which the reaction proceeds. In explosives, a fast reaction produces a very high pressure shock wave which is capable of shattering objects. In propellants, a slower reaction produces lower pressure over a longer period of time. Pyrotechnics evolve large amounts of heat but much less gas than explosives and propellants.

In general, the burning or detonation of products containing EM's involves exothermic redox chemistry. Whereas, the instant invention can be applied to the destruction of certain components of pyrotechnic compositions, it is more profitably applied to the destruction of EM's included in compositions which function primarily as explosives and/or propellants. The method of this invention, while applicable to the destruction of conventional explosive or propellant delivery means which may be a part of nuclear weapons, is not applicable to the destruction of the nuclear weapons themselves.

According to TM 9-1300-214, cited above, most EM's contained in weapons cannot be safely disposed of by dissolving them in water and treating the solutions as sewage, because they are generally insoluble in water, are often toxic, and are hazardous to the environment. It is said that disposal must be by burning, detonation, or chemical decomposition. Although elaborate precautions are mandated for disposing of even small quantities (grams) of EM's by burning or detonation, no other general methods of destruction by chemical means are set forth.

Reclamation of EM's using hot water or steam, for those EM's which melt, has been recommended. Trinitrotoluene (TNT), for example, can be melted by contact with boiling water or steam and thereby extracted from the warhead or other device in which it is found. The extraction is followed by precipitation with cold water. TNT can also be reclaimed by dissolution in, for example, benzene or xylene, followed by evaporation of the solvent. Many other EM's are not so readily reclaimed.

Explosive and especially propellant compositions can comprise complex mixtures of various inorganic and organic chemical compounds, as well as discrete, physically separate components in an explosive or propellant train. Various additives may be incorporated into the composition along with the EM's, for example, to control shock-sensitivity or, especially in the case of propellants, to maintain the flame temperature within a certain range and to achieve the maximum energy output given that temperature limitation.

The redox reactions of EM's are generally initiated in a small quantity of shock-sensitive primary explosive or primer using mechanical, electrical or thermal means, the primer in turn triggering a booster or secondary high explosive, which represents the largest EM component of the charge. Nitrogen-containing compounds are by far the most common EM's employed in booster and secondary charges, and many of them are inorganic nitrates and organic nitro compounds. However, the frequent incorporation into explosives and propellants of compounds which are neither nitrates nor organic nitro compounds, for example, the metal salts used as primers, has made it heretofore impossible to devise any chemical process sufficiently universal in its application that it can be trusted to destroy whatever EM or mixture happens to be present without the substantial risk of explosion.

Dissolving metal reduction chemistry is not new; it is embodied in the well known "Birch Reduction," which was first reported in the technical literature in 1944. The Birch Reduction itself is a method for reducing aromatic rings by means of alkali metals in liquid ammonia to give mainly the dihydro derivatives; see, for example, "*The Merck Index,*" 12th Ed., Merck & Co., Inc., Whitehouse Station, N.J., 1996, p. ONR-10.

Such dissolving metal reductions have been the subject of much further investigation and numerous publications. Reviews include the following: G. W. Watt, Chem. Rev., 46, 317–379 (1950) and M. Smith, "*Dissolving Metal Reductions,*" in "*Reduction: Techniques and Applications in Organic Synthesis,*" ed. R. L. Augustine, Marcel Decker, Inc., New York, N.Y., 1968, pages 95–170. Dissolving metal reduction chemistry is applicable to compounds containing a wide range of functional groups.

For example, alkylnitro compounds can be reduced to the corresponding alkylhydroxylamines with sodium and liquid ammonia; see M. Smith, cited above, p. 115, and aromatic nitro compounds can be reduced to the corresponding amines with a lithium/amine reagent; see, R. Benkeser and coworkers, *J. Am. Chem Soc.,* 80, 6593 (1958) and G. Watt, cited above, p. 356. The overall reaction from —$NO_2$ to —$NH_2$ requires 6 moles of active metal, for example Na, per mole of —$NO_2$; 2 moles of metal per mole of $_2$-NO produce the corresponding hydroxylamine, —NHOH. Dinitrocellulose is reported to yield an amine derivative when treated with sodamide in liquid ammonia; see P. Scherer and coworkers, *Rayon Textile Monthly,* 28 72 (1947); CA 2101f (1948). Very little technical literature is available which describes the dissolving metal reduction of compounds with more than one nitro group.

It is well known that most chemical reagents are species-specific; that is, a chemical reagent generally reacts with a substance having a certain specific functional group. An acid reacts with a base, much less commonly with another acid. An oxidizing agent reacts with a reducing agent. With such species-specific chemistry, destruction of an EM would seem to require one to first establish the identity of the EM or the mixture of EM's to be destroyed in order to select the right reagent or combination of reagents to react with that particular material.

Operationally, traditional chemical processing, as envisioned in the past, would frequently require handling and transferring of EM's by human operators. Such handling operations could include, for example, removal of the EM-containing explosive or propellant from a warhead or missile casing, canister or other containerized delivery system, thereby exposing personnel to the grave danger of contact with the EM. Loading the EM-containing material so-removed from its container into a separate reaction vessel would lead to another opportunity for exposure to the EM.

Finally, traditional chemical methods which might be proposed for the destruction of EM's would undoubtedly have high capital requirements for equipment, facilities, and personnel safeguards, as well as requiring time-consuming, labor-intensive processing. Then, there is the further cost of disposing of the products after the EM destruction chemistry has been carried out. In light of all this, one can understand why, compared against such chemical treatments, incineration or detonation of the EM-containing compositions, producing water, carbon dioxide and inorganic salts (ideally), has seemed relatively attractive.

DISCLOSURE OF INVENTION

Accordingly, there has been and continues to be a need for a safer, generally applicable chemical method for destroying EM's. The goals to be achieved by the method include the capability of destroying a wide range of EM's with differing functional groups which are contained in explosives, propellants, and so forth, safely, simply and economically with minimal affect on the environment, the flexibility to be employed over a wide range of temperatures, as well as the versatility to handle the EM's regardless of the weapon or container in which they are found, their current locus and physical state, and also including the possible presence of other candidates for destruction, such as CWA's.

It is the objective of this invention to provide a chemical method for destroying EM's which attains the aforesaid goals. Subsidiary objectives will become apparent hereinafter. Accordingly, the method of this invention subjects the EM's to a dissolving metal reduction. More specifically, in a preferred embodiment the method comprises the steps of creating a reaction mixture prepared from raw materials which include nitrogenous base, at least one EM, and active metal in an amount sufficient to destroy the EM, and then reacting the mixture.

It is believed that dissolution of an active metal, such as sodium, in a nitrogenous base, such as liquid ammonia, produces "solvated electrons," which are responsible for the intense blue color of the resultant solutions; that is:

$$\text{(I)}\ Na+(NH_3)_x \rightarrow Na^+(\text{solvated})+e^-(\text{solvated})$$

According to the present invention, the method for destroying an EM comprises, in a broad sense, treating the EM with solvated electrons. The method is applicable to the destruction of, not only EM's which are still primarily in the state in which they were produced, but surprisingly, also to EM's contained in explosives or propellants which have deteriorated, possibly over a number of years in storage, in some cases since the days of World War I or before, or were simply discarded by burial in a dump or landfill. Such explosives or propellants may by now have been transformed from their original state into products of unknown composition, toxicity and shock-sensitivity.

An unanticipated benefit of dealing with the destruction of, not only an EM, but with a combination of EM and CWA ("EM/CWA" hereinafter), when that is the case, is that the techniques applicable to substantially destroy CWA's, as disclosed and claimed in the earlier application, PCT/US96/16303, filed Oct. 10, 1996, are also applicable to the destruction of EM's. As a consequence and of great utility is the fact that, in the destruction of CWA's in close proximity to the very same EM's intended to deliver the weapons and propel the CWA's from the warheads, casings, shells, or other containments to their ultimate destination, it is possible to treat both the CWA and the EM components of the munitions with the same reagent and at the same time, thereby providing substantial savings in the cost and complexity of the demilitarization.

That is, the method of this invention has been found, quite unexpectedly, to be well suited to destroy the EM's, not only when presented in bulk, but also when still contained in the munitions in which they are found, the munitions optionally also including CWA's, in spite of the contaminants present there and the side reactions made possible by those contaminants. The reaction mixture can be created in situ, i.e., in the very shells, cartridges, missiles, or munitions in which the EM's or EM/CWA are found. Moreover, the method of this invention can also be applied in the remediation of soils contaminated with various EM's and also soils which include EM/CWA.

Many, if not most of the traditional chemical reactions heretofore proposed for weapons destruction, such as reactions between acids and bases, the hydrolysis of esters and amides with water, enolizations, and so forth are equilibria, the consequence of which is that the forward reactions do not go to completion. If such a reaction is used to treat an EM or EM-containing explosive or propellant, there is a distinct possibility that the EM will not be completely destroyed in the process. Surprisingly, the treatment of an EM using the method of this invention regularly leads to products in which residual EM is below the limit of detectability using conventional techniques, such as infrared and nuclear magnetic resonance spectroscopy as well as wet chemistry.

By employing the method of this invention, at least about 90 percent by weight of the EM, often more than about 95%, and in favorable cases, more than 97% is destroyed. Under optimum conditions, the method of this invention leads to at least about 99% destruction of the EM.

Whereas not intending or desiring to be bound by this explanation, in retrospect, this fortunate result may be due to the fact that the chemical reaction is not an ordinary chemical equilibrium. The reaction of solvated electrons at a covalent chemical bond, A-B, is believed to proceed as follows:

$$\text{A-B}+2[\text{Na}^+(\text{solvated})\ e^-(\text{solvated})]\ (\text{II})\ \text{Na}^+\ \text{A}^-\ (\text{solvated})+\text{B}^-\text{Na}^+\ (\text{solvated})$$

The reaction may proceed to substantial completion because the energy input required to reach the transition state from the solvent-stabilized products is very high, due to the repulsive force between the $A^-$ and the $B^-$ anions.

The method of this invention provides for the destruction of highly toxic and/or shock-sensitive EM's, generally producing substances of substantially less or substantially no toxicity to mammals and/or substantially lessened shock-sensitivity. In the context of this invention, the terms "destroying," "destruction" or the like as applied to EM's means transforming the energetic material into another chemical entity. In many cases, one or more chemical bonds are broken in the destruction.

Solvated electrons, unlike other species-specific reagents, are capable of performing as powerful reducing agents with respect to an extensive range of EM's, converting the organic compounds to salts or covalently bonded compounds and converting inorganics to free metals and/or by-products which are significantly lower in shock-sensitivity than the EM reactants. The resulting products are amenable to further treatment, if desired.

It is usually easier to create the solvated electrons which are required to carry out the preferred process of this invention by chemical means, such as the reaction between nitrogenous base containing the EM and active metal. However, the destruction of an EM by the method of this invention can be practiced, regardless of the source of the solvated electron reagent. For example, it is known that solvated electrons can be produced in nitrogenous base, as well in other solvating liquids, by electrochemical means. The resultant solvated electron-containing medium can also be employed in the process of this invention by reacting the EM or EM/CWA in that medium.

Although the process of this invention is perhaps most readily practiced with bulk supplies of EM's, the invention also contemplates the demilitarization of munitions in the delivery systems housing them. In an important variation, the process can be practiced in a manner which minimizes the handling of the EM's and the potential for exposure of process operating personnel to the EM's or EM/CWA.

Advantageously, the method of this invention can be carried out without actually separating the EM's or EM/CWA from the explosives or propellants of which they are a part, without removing the EM's from their native containers or analyzing to determine which specific EM's or EM/CWA are present. Instead, the present invention contemplates that the reactions constituting the method can be performed, where practical, directly in the munition, shell, canister, missile, barrel, or bulk packaging vessel containing the EM or EM/CWA, thereby minimizing worker exposure. That is, the reaction mixture, including the nitrogenous base, active metal, the EM-containing explosive or propellant, and the CWA if present, can be created within the native container itself, optionally where it is found and in the state in which it is found.

Techniques have been developed and are available by which warheads, shells and other native containers can be penetrated. Holes produced in the native container shells or casings provide access through which the nitrogenous base and the active metal can be injected. Alternatively, the solvated electron-containing reagent can be produced outside the native container and introduced through an opening or openings in the native container. Furthermore, the processing is so inexpensive and uncomplicated that treatment of the EM's (and CWA's if present), in their native containers and where they are found, from a solvated electron generator mounted on a mobile vehicle is contemplated.

The solvated electron-containing reagent can also be injected to rinse and decontaminate containers previously used to house EM's or EM/CWA. The method of the invention also includes detoxification and decontamination of containment devices, equipment, tools, clothing, soils, and other matrices and substrates contaminated with EM's and with CWA's if also present.

Although the method of this invention can be carried out in the native containers in which the EM's are found, in many cases, especially if the EM is available in bulk or is included in an explosive or propellant separated from a weapons container, it may be convenient to carry out the process of this invention in apparatus constructed for the purpose. Suitable apparatus was disclosed in the earlier application, PCT/US96/16303, filed Oct. 10, 1996, and incorporated herein by reference. That apparatus comprises a reactor system which is applicable to conducting a chemical reaction between a wide array of organic and inorganic compounds, preferably liquid compounds or compounds that can be liquified by melting or dissolution in a solvent, and a reagent including solvated electrons. The reactor system includes a reaction vessel to contain the reactant compounds in admixture with nitrogenous base containing solvated electrons, a condenser for treating gas evolved from the reaction vessel, a decanter for receiving reaction products from the reaction vessel and separating the reaction products into a liquid fraction and a solid fraction, and a dissolver for receiving the solid fraction and treating it with water or another solvent, producing a fluid mixture for further disposition.

The method of this invention will be clarified by reference to the detailed description, including the drawing, and the specific illustrative examples which follow.

MODES FOR CARRYING OUT THE INVENTION

Figure 1:
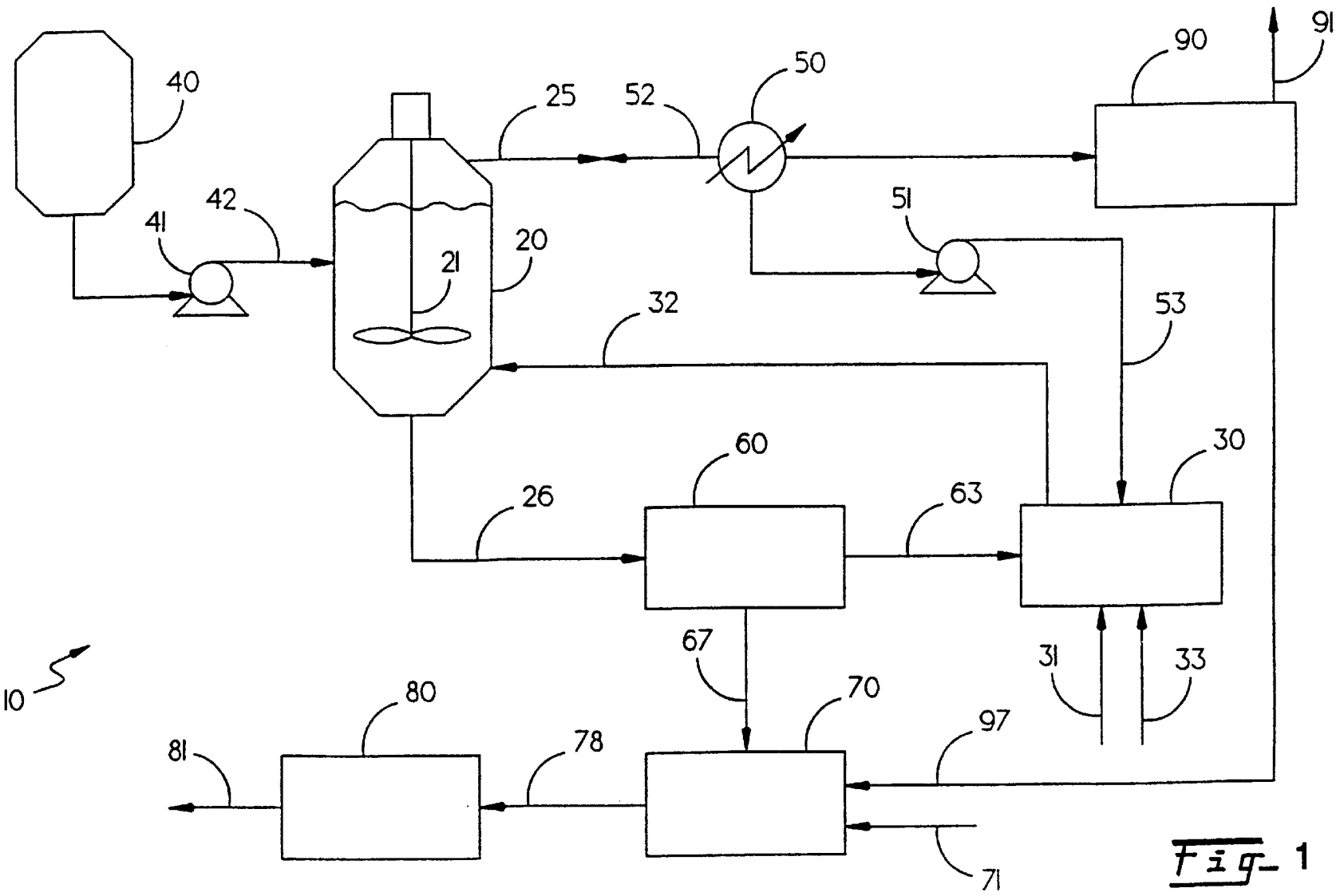
FIG. 1 is a flow diagram illustrating one embodiment of apparatus suitable for use in conducting the process of this invention. This apparatus was disclosed in the earlier application, PCT/US96/16303, filed Oct. 10, 1996, which application has been incorporated herein by reference.

Although the process of this invention is applicable to the destruction of a wide range of EM's incorporated into explosives, propellants and pyrotechnics, the method is especially effective when the EM or combination of EM's is the only component in the explosive, propellant or pyrotechnic device which reacts under the conditions imposed by the method of this invention. The method is most effective when the EM or combination of EM's is incorporated into an explosive or propellant composition. Pyrotechnics often contain predominantly pyrophoric materials, pigments and dyes, smoke emitting materials, and so forth which may lead to side reactions under the conditions imposed by the method of this invention. In the following description the names given the EM's are taken from TM 9-1300-214, cited above. This publication includes structural formulae for a number of the EM's as well as detailed information about them and is incorporated herein by reference.

The EM-containing explosives which are susceptible to treatment by the method of this invention include primary explosives, boosters and secondary explosives. Primary explosives are highly sensitive and are used as initiators to trigger the redox train of events leading to detonation. Booster charges are less sensitive and are employed in larger quantity to carry on the redox initiation and cause detonation of the secondary explosive, which is the main or bursting charge. The latter charge is the least sensitive material in the train. The EM's used in primary explosives tend to be somewhat different chemically than the booster and secondary explosives, but the booster and secondary explosives are conveniently treated together, since the same EM's can be employed in both.

The EM's included in primary explosives include, but are not necessarily limited to lead azide, $Pb(N_3)$; mercury fulminate, $Hg(ONC)_2$; 4,5-dinitrobenzene-2-diazo-1-oxide, "DDNP"; lead styphnate, which is a lead salt of 1,3-dihydroxy-2,4,6-trinitrobenzene; tetracene, also known as guanyldiazoguanyltetracene or 4-guanyl-1-(nitosoaminoguanyl)-1-tetracene; potassium dinitrobenzofuroxane, "KDNBF"; lead mononitroresorcinate, "LMNR"; and combinations thereof. These EM's all include either metal in a positive valence state, or at least one nitro or diazo group.

The EM's included in booster and secondary explosives include several classes, i.e., aliphatic nitrate esters, nitramines, nitroaromatics, ammonium nitrate, and mixtures of the immediately preceding. Industrial explosives may contain at least some of the same EM's used in weapons, as well as some other closely related compounds of similar structure.

Aliphatic nitrate ester EM's are characterized by containing $C\text{-}O\text{-}NO_2$ groups and include, but are not necessarily limited to, for example, 1,2,4-butanetriol trinitrate, "BTN"; diethyleneglycol dinitrate, "DEGN"; nitrocellulose, "NC," of which there are several types depending upon the nitrogen content; nitroglycerin, "NG" or glycerol trinitrate; nitrostarch, "NS," which is similar to nitrocellulose; pentaerythritol tetranitrate, "PETN"; triethyleneglycol dinitrate, "TEGN" or TEGDN"; and 1,1,1-trimethylolethane trinitrate, "TMETN" or "MTN."

Nitramine EM's are characterized by containing $N\text{-}NO_2$ or $N+\text{-}NO_3$-groups and include, but are not necessarily limited to, for example, cyclotetramethylenetetranitramine, "HMX"; cyclotrimethylenetrinitramine, "RDX"; ethylenediamine dinitrate, "EDDN"; ethylenedinitramine, "Haleite"; nitroguanine, "NG"; and 2,4,6-trinitrophenylmethylnitramine, "Tetryl", which could also be classified as a nitroaromatic; see below.

Nitroaromatic EM's are characterized by containing one or more $C\text{-}NO_2$ structural units and include, but are not necessarily limited to, for example, ammonium picrate, "Dunnite" or ammonium 2,4,6,-trinitrophenolate; 1,3-diamino-2,4,6-trinitrobenzene, "DATB"; 2,2',4,4',6,6'-hexanitroazobenzene, "HNAB"; hexanitrostilbene, "HNS"; 1,3,5,-triamino-2,4,6-trinitrobenzene, "TATB"; and 2,4,6-trinitrotoluene, "TNT."

Ammonium nitrate, $NH^+NO_3^-$, is in a class by itself and is the least sensitive of the military explosives. A number of other named explosives are obtained by mixing various EM's, and a myriad of combinations are possible, only a representative number of which are described here; others are described in TM 9-1300-214, cited above, and similar publications. These include binary mixtures, for example, the "Amatols," which are mixtures of ammonium nitrate and TNT; "Composition A," a mixture of RDX and a desensitizer such as wax; "Composition B," "cyclotols," which are RDX plus TNT; "Composition C," RDX plus plasticizer; "Ednatols," Haleite and TNT; "Octols," mixtures of HMX and TNT; and "Pentolite," which is PETN/TNT; and so forth.

Ternary mixtures include "Amatex 20, which contains RDX, TNT, and ammonium nitrate; and the "Ammonals," which are mixtures of ammonium nitrate and aluminum, together with high explosives, such as TNT, DNT and RDX. Other named mixtures include "HBX," "H-6," "HTA," "Minol-2," "Torpex," and so forth. A quaternary explosive is exemplified by "BBX" which includes TNT, RDX, ammonium nitrate and aluminum metal. Other mixtures include the plastic-bonded explosives or "PBX" explosives which contain one or more high explosives, for example, RDX, HMX, HNS, and/or PETN in admixture with a polymeric binder, rubber, plasticizer, and a fuel, such as powdered aluminum or iron.

Explosives classed as industrial explosives includes dynamite, which comprises mixtures of nitroglycerin and clay, such as Kieselguhr. Another widely used industrial explosive is the combination of ammonium nitrate and fuel oil, "ANFO." Water gel and slurry explosives are also used industrially and can include ammonium nitrate, Pentolite, TNT, etc. as the EM's.

While not desiring or intending to be bound by this explanation, it is believed the method of this invention destroys the aforesaid explosive mixtures and industrial explosives in the same way the individual component explosives are destroyed as set forth hereinabove.

The EM's contained in propellants are some of the same EM's employed in explosives and described above. The principle EM's used in propellants include nitrocellulose, nitroglycerine and nitroguanidine. Other components typically are present to control the flame temperature, maximize energy content at that temperature, reduce the tendency of a gun to exhibit secondary flash, minimize barrel erosion, provide useful physical properties to the propellant, and control cost. The following components, along with general ranges in the amounts of several of them, can be found in typical propellants, although not all of these ingredients are necessarily present in a single propellant.

TABLE 1

Typical Components of Propellant Compositions

| Component | Range (Wt %) |
|---|---|
| Nitrocellulose (~13% N) | 20–100 |
| Nitroglycerin | 10–43 |
| Nitroguanidine | 48–55 |
| Barium nitrate | 1.4 |
| Potassium nitrate | .75–1.25 |
| Lead carbonate | |
| Lead stearate | |
| Dinitrotoluene | 8–10 |
| Dibutylphthalate | 3–9 |
| Diethylphthalate | 3 |
| Dimethylphthalate | |
| Diphenylamine | .7–1 |
| Nitrodiphenylamine | |
| Ethyl centralite | .6–1.5 |
| Graphite | .1–.3 |
| Cryolite | .3 |
| Triacetin | |

The non-EM components of typical propellants do not appreciably affect the method of this invention, and destruction of the EM components proceeds as expected, based on their chemical structure as set forth hereinabove.

With regard to the active metal to be employed in the method of this invention, whereas the literature reports the use of a number of other metals, such as Mg, Al, Fe, Sn, Zn, and alloys thereof in dissolving metal reductions, in the method or process of this invention, it is preferred that the active metal be selected from one or a combination of the metals found in Groups IA and IIA of the Periodic Table of the Elements; that is, the alkali and alkaline earth metals. Largely for reasons of availability and economy, it is most preferred that the active metal be selected from Li, Na, K, Ca, and mixtures thereof. In most cases, the use of sodium, which is widely available and inexpensive, will prove to be satisfactory.

The nitrogenous base which is required in this process can be selected from ammonia, amines, and the like, or mixtures thereof. Anhydrous liquid ammonia is readily available, since it is widely employed as a fertilizer in agricultural applications. Consequently, it is also relatively inexpensive and so is the preferred nitrogenous base. However, ammonia boils at about −33° C., requiring that solutions of liquid ammonia be cooled, that the solution be pressurized, or both, unless the vaporized ammonia is otherwise replaced. In those cases where this is inconvenient, a number of amines are readily available and can be employed as the nitrogenous base.

Representative classes of useful amines include primary amines, secondary amines, tertiary amines, and mixtures thereof. Specific examples of such amines include alkyl amines, like methyl amine, ethyl amine, n-propyl amine, iso-propylamine, 2-methylpropylamine, and t-butylamine, which are primary amines; as well as dimethylamine and methylethylamine, which are secondary amines; and tertiary amines, such as triethylamine. Di- and trialkylamines can also be employed, as can saturated cyclic amines such as piperidine. Amines which are liquids at the desired reaction temperature are preferred and, among these amines, methylamine (bp −6.3° C.), ethylamine (bp 16.6° C.), propylamine (bp 49° C.), isopropylamine (bp 33.0° C.), butylamine (bp 77.8° C.), and ethylenediamine (bp 116.5° C.), are especially useful. In some cases it will be advantageous to combine the nitrogenous base with another solvating substance such as an ether; for example, tetrahydrofuran, diethyl ether, dioxane, or 1,2-dimethoxyethane, or a hydrocarbon; for example, pentane, decane, and so forth. In selecting the nitrogenous base and any cosolvents to be included therewith, it should be borne in mind that solvated electrons are extremely reactive, so it is preferred that neither the nitrogenous base nor any cosolvent included therewith contain groups which compete with the EM and react with the solvated electrons. Such groups include, for example, aromatic hydrocarbon groups which may undergo the Birch reduction, and acid, hydroxyl, sulfide, halogen, and ethylenic unsaturation, and they should, in general, be avoided unless they are contained in the substance to be destroyed so as to prevent undesirable side reactions which consume reactants unprofitably. Water should also be avoided, although water can sometimes be effectively utilized in the product work-up. In some cases it has been reported that the presence of an hydroxyl-containing alcohol may be beneficial.

In spite of these admonitions, it has been found, quite surprisingly, that even if a dissolving metal reduction is carried out in the field in the presence of moisture, air, and a range of contaminants which could be expected to interfere, the destruction of EM's by the method of this invention is, nevertheless, very successful.

Although other conditions can sometimes be employed to advantage, the method of this invention is preferably carried out at a temperature in the range of about −35° C. to about 50° C. and, although the reaction can be carried out at subatmospheric pressure, it is preferred that the method be performed in the pressure range of about atmospheric pressure to about 21 $Kg/cm^2$ (300 psi). More preferably, the reaction is carried at about room temperature, e.g., about 20° C. (68° F.), under a pressure of about 9.1 $Kg/cm^2$ (129 psi).

In carrying out the method of this invention, the ratio of nitrogenous base/EM in the reaction mixture is preferably between about 1/1 to about 10,000/1 on a weight/weight basis, more preferably between about 10/1 and 1000/1, and most preferably between about 100/1 and about 1000/1.

The amount of active metal should preferably be in the range of about 0.1 percent to about 12 percent by weight based on the weight of the mixture; more preferably between about 2 percent and about 10 percent.

On a metal weight/EM weight basis the reaction mixture preferably contains between about 0.1 and 2.0 times as much metal as EM, more preferably between about 0.15 and about 1.5 times as much, and most preferably between about 0.2 and about 1.0 as much metal as EM. In any case where active metal is employed, on a molar basis the reaction mixture should contain at least 2 moles of the active metal per mole of EM if destruction of the EM requires that a covalent bond be broken. If the EM destruction requires breaking an ionic bond, as in a salt, active metal in molar amount at least equal to the molar amount of the EM multiplied by the positive charge formally exhibited by the cationic component of e bond should be employed.

The course of the reaction involving solvated electrons can be followed readily by monitoring the blue color of the reaction mixture which is characteristic of solutions of nitrogenous base and active metal, that is, solvated electrons. When the blue color disappears, it is a signal that the EM has reacted with all of the solvated electrons, and more active metal or solution containing solvated electrons can be added to ensure that at least the stoichiometrically necessary amount of active metal has reacted per mole of EM. In many cases it is preferred that the addition of active metal or additional solvated electrons be continued until the EM has completely reacted with the solvated electrons, a state which is signaled when the blue color of the mixture remains. The rate of the reaction between the EM's and solvated electrons is rapid, the reaction in most cases being substantially complete in a matter of minutes to a few hours.

In an especially preferred embodiment of the method of this invention, the process comprises first creating a reaction mixture prepared from raw materials which include:

1) nitrogenous base selected from the group consisting of ammonia, amines, and mixtures thereof; the amines being selected from the group consisting of methylamine, ethyl amine, propylamine, isopropylamine, butylamine, and ethylenediamine; (2) at least one EM contained in a composition selected from the group consisting of explosives, propellants and pyrotechnics; and then reacting the mixture to destroy at least about 90 percent, preferably at least about 95, and most preferably at least about 99 percent by weight of the EM.

At least when used in the field, it is preferred that a solution comprising the active metal and nitrogenous base be separately produced and then added to a nitrogenous base solution which contains the EM. It is also advisable that, at the completion of the process, any residual, excess, unreacted active metal be destroyed, for example, by adding an alcohol, such is isopropanol, to the reaction mixture prior to removing the nitrogenous base.

The EM destruction reaction may be performed in the native container, particularly in those instances when there is a sufficient volume of unoccupied space remaining to accommodate the reactants required for performing the process. Likewise, the container housing the EM should be in suitable condition for conducting the reaction. A container of EM which has been buried in the ground for some time period and has undergone corrosion may not be in suitable condition to be employed as a reaction vessel. However, the difficulty in these cases arises, not because the EM may be decomposed, but because the container may not provide sufficient physical integrity to contain the reaction mixture.

The invention may also be performed in a reactor or reactor system suitable for accommodating original native containers which may have an insufficient volume of unoccupied space to allow for the introduction of the required amount of nitrogenous base or externally-produced solution of solvated electrons, or are in such poor physical condition as not to be able to contain and confine the reaction mixture. In these cases, the EM destruction can be carried out by opening the native containers, or severing them and placing the opened or severed container parts with the EM in a larger dedicated reactor system or reaction vessel for purposes of conducting the EM destruction reaction. Using this procedure, both the EM's and the native containers can be simultaneously treated.

No matter whether the destruction of the EM is carried out in its native container, in the field, in a reactor system, or in a reaction vessel using a bulk source of the EM, at least two moles of solvated electrons are ordinarily required for every mole of the EM to be destroyed if a covalent bond is to be broken. This follows since it is believed that two moles of solvated electrons are required to break a covalent chemical bond; see equation (II) above. On the other hand, it may be beneficial to employ excess solvated electrons, that is, sufficient solvated electrons to break as many as perhaps about two to four bonds, or more, in the EM, for example. The products resulting from the more extensive reaction of the EM can be easier to handle from a safety and/or environmental point of view.

In the event the EM is found in a munition which includes CWA which is also to be destroyed, it will be evident that the quantities of nitrogenous base and active metal must be adjusted to recognize the presence of the CWA if both the EM and the CWA are to be destroyed. In general terms, the ratios in amounts of the various components of the reaction mixture are similar regardless of whether an EM or CWA is being reacted; thus, the amounts of EM and CWA to be destroyed generally can simply be added together, and the amounts of the other components of the reaction mixture readily calculated from the ratios provided above.

Although the process of this invention is applicable to the destruction of a wide range of CWA's in combination with EM's, including those CWA's which are the subject of patent application PCT/US96/16303, filed Oct. 10, 1996 and incorporated herein by reference, the method is especially effective when the CWA is selected from the group consisting of vesicants, nerve agents, and mixtures thereof, the formula of said vesicants containing at least one group of the formula:

(III)

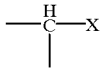

in which X is halogen; said nerve agents being represented by the formula:

(IV)

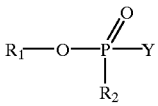

in which $R_1$ is alkyl, $R_2$ is selected from alkyl and amino, and Y is a leaving group.

In the vesicants to which the process of this invention can be applied it is preferred that X in the aforesaid formula (III) be selected from fluorine, chlorine and bromine. In the vesicants most commonly found around the world, X is chlorine, and it is especially preferred that X in formula (III) be chlorine for that reason. Two of the most widely available, and thus important, vesicants to which the process is applicable are mustard gas, also called "HD," or 1,1'-thiobis[2-chloroethane), or di(2-chloroethyl) sulfide and "Lewisite," or dichloro(2-chlorovinyl)arsine.

In the nerve agents of formula (IV) to which the process of this invention can be applied, Y is a leaving group; that is, Y is an atomic grouping which is energetically stabile as an anion, the more preferred leaving groups being those which are most readily displaced from carbon in nucleophilic substitutions and, as anions, have the greatest stability. Although a host of such leaving groups are well known, it is preferred that the leaving group Y be selected from halogen, nitrile (—CN), and sulfide —S—), since these are the groups Y present in the nerve agents distributed most widely throughout the world. Among the halogens, it is most preferred that Y be fluorine, chlorine or bromine, fluorine being especially effective in the most readily available nerve agents.

$R_1$ in formula (IV) can be alkyl, preferably lower alkyl, i.e., $C_1$–$C_6$, straight chain or branched or cyclic, e.g., methyl, ethyl, propyl, iso-propyl, iso-butyl, tert-butyl, cyclohexyl, or trimethylpropyl. $R_1$ in the most widely distributed nerve agents is methyl, ethyl or 1,2,2-trimethylpropyl and so these alkyl groups are preferred for that reason.

$R_2$ in formula (IV) can be alkyl or amino. In the case that $R_2$ is alkyl, it is preferred that alkyl be as defined above for $R_1$, alkyl $R_2$ in the most widely distributed nerve agents being methyl, the most preferred alkyl $R_2$ being methyl for that reason. In the case that $R_2$ is amino, $R_2$ can be primary, secondary or tertiary alkylamino, or dialkylamino, or trialkylamino, alkyl being as defined above for $R_1$, dialkylamino being preferred, with dimethylamino being especially preferred for the reason that $R_2$ is dimethylamino in the most widely distributed nerve agent in which $R_2$ is amino.

Specific nerve agents which are widely distributed around the world, and hence are the most important nerve agents to which the process of this invention can be applied, are: "Tabun," or "GA," or dimethylphosphoramidocyanidic acid, or ethyl N,N-dimethyl phosphoroamicocyanidate; "Sarin," or "GB," or methylphosphonofluoridic acid 1-methyl ethyl ester, or isopropyl methyl phosphonofluoridate; "Soman," or "GD," or methylphosphonofluoric acid 1,2,2-trimethylpropyl ester, or pinacolyl methyl phosphonofluoridate; and "VX," or methylphosphonothioic acid S-[2-[bis (1-methyl ethyl)amino]ethyl] ethyl ester, or ethyl S-2-diisopropyl aminoethyl methylphosphorothioate.

Regardless of whether the destruction of the EM or EM/CWA combination is carried out in its native container or in a reactor system using a bulk supply of the material to be destroyed, the process may include an optional, but often preferred step following initial destruction of the material. That is, subsequent to the application of solvated electrons, the residual product mixture is optionally (but desirably) oxidized, preferably by non-thermal means, by reacting the products of the EM or EM/CWA destruction with a chemical oxidant. Preferably, however, before introducing the oxidant, residual nitrogenous base is removed, for example, ammonia is removed from the reactor by allowing remaining vapors to evaporate. Representative oxidants and mixtures of oxidants which may be employed include hydrogen peroxide, ozone, dichromates and permanganates of alkali metals, and so on. In carrying out this additional step optimally, the process requires introducing into the reactor system or native container containing the product residue a sufficient amount of a suitable oxidizing agent to completely react with any residual organic products remaining from the initial reaction with the solvated electrons or nitrogenous base. The purpose of this oxidation step is to take any residual organic moieties to their highest possible oxidation states, and if reasonably achievable, to carbon dioxide and water.

Hence, if post-destruction oxidation is to be employed, the EM or EM/CWA combination is first reacted with solvated electrons, followed by a secondary treatment step which comprises reacting the residuals with an oxidizing agent.

When the method of this invention is employed in the remnediation of soils which are contaminated with one or more EM's or with one or more EM's in combination with one or more CWA's, it is possible to proceed down either of two paths. The contaminated soil itself can be treated according to the process of this invention, or alternatively, the contaminant(s) can be concentrated in a certain fraction of the contaminated soil first, for example, in the soil fines, and then that concentrated fraction can be treated. These possibilities are described in U.S. Pat. Nos. 5,110,364; 5,495,062; 5,516,968; and 5,613,238, for example, the disclosures of which are incorporated herein by reference. Because of the added danger of explosion which could result by concentrating the EM's, it is preferred that the contaminants not be concentrated before applying the method of this invention to the remediation of a soil containing an EM.

INDUSTRIAL APPLICABILITY

The method of this invention is applicable to the destruction of specific representative EM's which include nitrocellulose, a typical aliphatic nitrate ester; RDX or cyclotrimethylenetrinitramine, a nitramine-type explosive; TNT, a nitroaromatic; and Composition B, a binary mixture of RDX and TNT containing several adjuvants as follows:

TABLE 2

Composition B

| Component | Wt % |
|---|---|
| RDX | 59.2 |
| TNT | 39.3 |
| Wax | 1.0 |
| Calcium silicate | 0.5 |
| Water | trace |

The method is also applicable to the destruction of the M-28 rocket propellant having the following composition:

TABLE 3

M-28 Propellant

| Component | Wt % |
|---|---|
| Nitrocellulose | 60.0 |
| Nitroglycerin | 23.8 |
| Triacetin | 9.9 |
| Dimethylphthalate | 2.6 |
| Lead stearate | 2.0 |
| 2-Nitrodiphenylamine | 1.7 |

Unless otherwise stated, tests were conducted under ambient pressure using anhydrous liquid ammonia at its reflux temperature (about −33° C.). Sodium was employed as the active metal unless noted otherwise. A number of small scale reactions were conducted in 1 liter Erlenmeyer flasks equipped with magnetic stirrers. Larger scale reactions were carried out in a cylindrical Pyrex reactor, about 25 cm in diameter and about 45 cm high. In the latter, mechanical stirring was provided with a 2-bladed glass paddle. In general, the following procedures were used for both the small and larger scale experiments unless otherwise stated.

The desired amount of anhydrous liquid ammonia was first transferred from a storage cylinder into the reaction vessel, ammonia which evaporated during the experiment being replaced periodically during the experiment. An initial portion of the subject EM to be reacted was then weighed and added to the flask. The ammoniacal solution was then essentially titrated with the sodium metal. That is, an initial small portion (usually about 0.2 g) of the desired amount of sodium was weighed and added to the reaction mixture. Addition of the sodium generally led to a swirling blue-black stream characteristic of solvated electrons as the mixture was stirred. When the color disappeared, additional sodium was added portion-wise until the solution again became blue-black. Another portion of the subject EM was then introduced, followed by additional portions of sodium until the end-point persisted. The alternate additions of the subject EM and sodium were repeated until the entire intended amount of the subject EM had been added. Sodium was then added a small portion at a time until the blue color persisted for five minutes, at which point the reaction was deemed to be complete. The blue color very gradually disappeared over time absent further reactant addition, perhaps due to side reactions of the sodium, so as a practical matter, it was necessary to set the 5 min. time limit.

Upon completion of the reaction, isopropanol was generally added to the reaction mixture to destroy any unreacted sodium, and the ammonia was allowed to evaporate. In a number of cases the residual reaction product was subjected to various analyses and tests.

Reactant EM's and their degradation products were analyzed using U.S. Environmental Protection Agency ("EPA") Method 8330, "Nitroaromatics and Nitroamines (Ordnance) Analysis by High Performance Liquid Chromatography (HPLC)." This method is intended for the analysis of explosives residues at parts per billion levels in water, soil and sediment matrices. The method utilizes reverse phase high performance liquid chromatography ("HPLC") with photodiode array ultraviolet ("UV") detection. A detailed description of Method 8330 and procedures for its use is available from the U.S. Environmental Protection Agency, 401 M Street Southwest, Washington, D.C. USA 20460, and that description is incorporated herein by reference. In preparing the samples to be used in the Method 8330 procedure, approximately 0.2 g of the material to be analyzed and 10 ml of acetonitrile were shaken together in a 50 ml capped vial for 2 hours. The contents of the vial were then filtered; the filtrate was made up to 15 ml with acetonitrile, transferred to a clean scintillation vial and subjected to Method 8330. The chemical compounds of interest herein which were determined by Method 8330, together with their measured detection limits, are listed in Tables 4, 5 and 6 which follow:

TABLE 4

Nitroaromatics Determined Using HPLC

| Compound | Detection Limit (μg/g) |
|---|---|
| 1,3,5-Trinitrobenzene ("TNT") | 0.75 |
| 1,3-Dinitrobenzene | 0.30 |
| Nitrobenzene | 0.30 |
| 2,4,6-Trinitrotoluene | 0.30 |
| 4-Amino-2,6-dinitrotoluene | 0.15 |
| 2-Amino-4,6-dinitrotoluene | 0.15 |
| 2,4-Dinitrotoluene | 0.53 |
| 2,6-Dinitrotoluene | 0.08 |
| 2-Nitrotoluene | 0.30 |
| 3-Nitrotoluene | 0.23 |
| 4-Nitrotoluene | 0.30 |

TABLE 5

Nitramines Determined Using HPLC

| Compound | Detection Limit (μg/g) |
|---|---|
| Cyclotetramethylenetetranitramine ("HMX) | 0.60 |
| Cyclotrimethylenetrinitramine ("RDX") | 0.83 |
| 2,4,6-Trinitrophenylmethylnitramine ("Tetryl") | 0.60 |

TABLE 6

Aliphatic Nitrate Esters Determined Using HLPC

| Compound | Detection Limit (μg/g) |
|---|---|
| Trinitroglycerin | 0.98 |
| Ethylene glycol dinitrate | 1.35 |
| Diethylene glycol dinitrate | 0.53 |
| Triethylene glycol dinitrate | 0.30 |
| Pentaerythritol tetranitrate | 0.68 |
| 1,2,4-Butanetriol trinitrate | 0.68 |
| 1,1,1-Trimethylolethane trinitrate | 0.68 |

Nitrogen-containing EM's, including nitrocellulose and its degradation products were also subjected to analysis for nitrite and nitrate by capillary zone electrophoresis ("CZE") using a Hewlett-Packard 3D capillary electrophoresis system. The instrument was calibrated with sodium nitrite and magnesium nitrate in the 1 μg/g to 100 μg/g range.

In the case of free nitrite/nitrate, approximately 0.2 g of the test sample and 10 ml of water were placed in a 50 ml capped vial and shaken for 2 hrs. The contents of the vial were then filtered and the filtrate, made up to 15 ml with water, was transferred to a clean scintillation vial and analyzed for nitrite/nitrate by CZE. In the case of nitrocellulose and its degradation products, approximately 0.2 g of the test sample and 10 ml of acetone were first combined in a 50 ml vial, capped and shaken for 2 hrs. The test sample was then dried under nitrogen at room temperature, and the residue was combined with 10 ml of water in a 50 ml capped vial and shaken for 10 min. The aqueous sample was then filtered, the empty sample vial being rinsed with 10 ml of water and then with 20 ml of methanol. The filter carrying the sample residue was then transferred to a 250 ml beaker, 10 ml of acetone was added, and the beaker was swirled occasionally for about 10 min. The supernatant acetone was transferred to a clean vial and combined with 5 ml of acetone used to rinse the beaker. The vial's contents were then dried at room temperature under a nitrogen steam, following which 5 ml of 1 N NaOH was added to the vial. After capping, the vial was placed in a 100° C. oil bath for 30 min., swirling the contents approximately every 10 min. After cooling to room temperature, 10 ml of water was added to the vial. The resultant aqueous solution was subjected to nitrite/nitrate analysis by CZE.

The EM's and degradation products were also analyzed by NMR and infrared spectroscopy. A Varian VXR-300 NMR spectrometer, operating at 300 MHz for $^{1}H$ and at 75.4 MHz for $^{13}C$, was employed for NMR spectra, and a Digilab FTS-15E Fourier transform infrared (FT-IR) spectrometer coupled with a Bio-Rad FT-IR workstation was used to obtain the IR spectra. The samples for the IR spectra were prepared either by casting them from acetone or methylethyl ketone, or by making a salt disk and using the diffuse reflectance method. Residue spectra were compared to the baseline components and to reference spectra in making identifications.

In general, whereas the starting materials were readily monitored using the aforesaid analytical methods, the products resulting from the destruction of EM's by the method of this invention were, in most cases, intractable oils or viscous tars which provided few analytically satisfying answers as to the fate of the organic portions of the reactants. This is tentatively attributed to the formation of polymeric materials during the course of the reactions.

In some cases, the reaction products resulting from application of the method of this invention to various EM's were subjected to certain tests designed to determine the sensitivity of the reaction products to stimulii tending to induce explosion. Included were tests for sensitivity to impact, sliding friction, electrostatic discharge, thermal stability, and small scale burning. In carrying out four of these tests, apparatus designed by the Southwest Research Institute, 6220 Culebra Road, San Antonio, Tex. USA 78228-0510, was utilized; that is, in the tests for impact sensitivity, sliding friction sensitivity, electrostatic sensitivity, and thermal stability. Descriptions of the test apparatus and procedures are available from Southwest Research Institute at the cited address, and those descriptions are incorporated herein by reference.

In the small scale burning tests, approximately 125 g of the substance to be tested was placed in a 20 ml plastic beaker or other appropriate container. The loaded container was then placed on a bed of kerosene-soaked sawdust. Using a remotely actuated igniter, the sawdust was ignited and the test substance observed for detonation or explosion. Failure to observe explosion or detonation in any of three replications qualified the test substance as unlikely to explode or detonate when burned.

EXAMPLE 1

Destruction of Nitrocellulose

Run A:

Nitrocellulose (0.25 g) and liquid ammonia (20–30 ml) were combined in a flask, and sodium (0.25 g) was added in portions with stirring. Upon completion of the reaction, isopropanol was added to quench any unreacted sodium, and the ammonia and alcohol were evaporated, affording a yellow solid.

Run B:

Nitrocellulose (1.0 g) and liquid ammonia (300 ml) were combined in a flask; no reaction was apparent. Sodium (1.0 g) was then added in portions with stirring, whereupon reaction ensued. Upon completion of the reaction, isopropanol was added to quench any unreacted sodium, and the ammonia and alcohol were evaporated, yielding a tan solid which was very soluble in water and methanol but not in acetone, methylethylketone, chloroform, hexane, or tetrahydrofuran. In contrast, the nitrocellulose reactant was soluble in acetone and methylethylketone. Analysis of the solid indicated the presence of nitrates and nitrites, but no organic products were identified by means of IR and NMR spectroscopy.

Run C:

Liquid ammonia (325 ml) was added to a 1 l flask. Nitrocellulose (1.01 g) and sodium (1.592 g) were added alternately and portion-wise to the stirred ammonia. The solution became viscous during the course of the reaction and the presence of bubbles became more apparent. The dark blue color of the solution persisted for >5 min. after all the sodium had been added, signaling completion of the reaction. The residue, after evaporation of the ammonia, weighed 3.157 g and was soluble in water but not in acetone. The nitrocellulose starting material was soluble in acetone. Complications in the spectra of the reaction product, perhaps due to the production of polymeric products, prevented product identification. The nitrite and nitrate levels in the residue were 1088 $\mu$g/g and 142 $\mu$g/g, respectively.

EXAMPLE 2

Destruction of TNT

TNT in the form of granules was obtained from the Accurate Arms Company, McEwen, Tex. USA.

Run A:

TNT was combined with liquid ammonia in a flask, producing a deep red color. An amount of sodium equal in weight to the TNT was added in portions with stirring, causing the red color to lighten and the blue color of solvated electrons to appear. As the blue color dissipated after each sodium addition, a green color first appeared, followed by a coffee brown color. Upon completion of the reaction, isopropanol was added to quench any unreacted sodium. Evaporation of the alcohol and ammonia left an amorphous dark solid. Analysis of the solid by IR and NMR ($^1$H) spectroscopy indicated the absence of TNT upon comparison against authentic spectra of TNT.

Run B:

Liquid ammonia (900 ml) was added to a 1 l flask. TNT (1.002 g) and sodium (1.057 g) were added aternately and portion-wise to the stirred ammonia. Immediately upon addition of TNT the solution turned dark cranberry red. As the sodium was added, the solution turned from red to a greenish brown and then to an olive green before turning and remaining blue for >5 min. as the last sodium was added. The residue (2.705 g), after ammonia evaporation, was a brown, rust-colored paste in which no residual TNT was detected by HPLC. The nitrite and nitrate levels in the residue were 18 $\mu$g/g and 98 $\mu$g/g, respectively. The NMR spectrum of the residue showed no TNT remaining in the residue; no specific decomposition products could be identified, suggesting a mixture of products. The residue was tested for impact sensitivity; the results were negative up to the apparatus limit of 132 J (97 ft-lb) . In contrast, TNT became impact sensitive at 44 J (32 ft-lb) in the same test.

Run C:

Run B is repeated, except that the sodium is replaced with 0.33 g of lithium. Substantially the same results as in Run B are obtained.

Run D:

Run B is repeated, except that the liquid ammonia is replaced with ethylamine, and the amounts of TNT and sodium are reduced to approximately 0.5 g each. Substantially the same results as in Run B are obtained.

Run E:

Run B is repeated, except that calcium metal (1.8 g) is substituted for the sodium. Substantially the same results as in Run B are obtained.

EXAMPLE 3

Destruction of RDX

The RDX was obtained in the form of granules from the Accurate Arms Company, McEwen, Tex. USA.

Run A:

RDX was combined with liquid ammonia in a flask to produce a reaction mixture having a yellow color. An amount of sodium equal to that of the RDX was added portion-wise with stirring, causing the yellow color to be replaced by the blue color characteristic of solvated electrons. When the reaction was complete, isopropanol was added to quench any unreacted sodium, after which the alcohol and ammonia were evaporated, affording a light tan solid. Analysis of the solid by means of IR and NMR ($^1$H) spectroscopy showed the absence of RDX by comparing the spectra against authentic spectra of RDX.

Run B:

Liquid ammonia (600 ml) was added to a 1 l flask. RDX (1.087 g) and sodium (1.347 g) were added alternately and portion-wise to the stirred ammonia. The solution turned yellow with small blue-black droplets as the first sodium was added to the RDX in ammonia. This was replaced with a persistent dark blue color as the additions continued and were completed. The reaction product (2.696 g), after ammonia evaporation, was an off-white dry flaky material. RDX could not be detected in the residue. The nitrite and nitrate levels in the residue were 119 $\mu$g/g and 30 $\mu$g/g, respectively. The residue was not sensitive to impact up to the limit of the apparatus, 132 J (97 ft-lb). In contrast, RDX became impact-sensitive at 15 J (11 ft-lb) in the same test.

Run C:

To liquid ammonia (100 ml) in a stirred flask was added RDX (1 g). No active metal was added. The RDX was not dissolved after 1 hour and 16 minutes. The residue, after removing the ammonia, weighed 0.941 g and was not soluble in water but dissolved in acetone. The NMR spectrum of the residue showed only RDX.

Run D:

Into three separate 1 l flasks containing stirred liquid ammonia (100 ml each) was added RDX (1.00 g each). Sodium (0.100 g) was added to the first flask, sodium (0.260 g) to the second, and sodium (0.504 g) to the third flask. The colors of the solutions were opaque, bright yellow and olive-green, respectively. The residues, after ammonia evaporation, weighed 0.977 g, 0.974 g and 1.513 g, respectively. Analysis of the residues showed the presence of unreacted RDX at the levels of 383,000 $\mu$g/g, 2,230 $\mu$g/g and 20.6 $\mu$g/g, respectively, leading to the conclusion that, on a weight/weight basis, at least about one-half as much sodium as RDX was required to destroy the RDX.

Run E:

Run B is repeated, except that the liquid ammonia is replaced by ethylenediamine (900 ml). Substantially the same results as in Run B are obtained.

EXAMPLE 4

Destruction of Composition B

Composition B was obtained from Accurate Arms Company of McEwen, Tex. USA in the form of brittle sheets about 0.5 cm thick. The sheet was broken into smaller particles no more than 1 cm in size prior to use.

Run A:

To stirred liquid ammonia (650 ml) in a 1 l flask was added alternately and portion-wise Composition B (1.032 g) and sodium (1.153 g). As the additions of the EM and sodium reactants were made, the solution turned brown and, finally, dark blue as the last of the sodium was added. After removing the ammonia, a dark brown viscous paste residue (1.700 g) remained. The residue was analyzed by NMR spectroscopy and found to contain no detectable RDX or TNT. The nitrite and nitrate contents of the residue were 33 $\mu$g/g and 2 $\mu$g/g, respectively. The residue was not impact-sensitive up to the limit of the apparatus, 132 J (97 ft-lb). In contrast, Composition B became impact sensitive at 20 J (15 ft-lb) in the same test. In the test for stability to electrostatic discharge, the residue exhibited a minimum ignition energy of 185 mJ, whereas Composition B ignited at an energy of 100 mJ. In a thermal stability test, the residue exhibited no instability. In the sliding friction test Composition B exhibited reaction, but the residue did not. In the small scale burning test using a 125 g sample of the product residue, the residue burned without explosion or detonation.

Run B:

Run A was repeated using 950 ml of liquid ammonia, 4.287 g of Composition B, and 4.246 g of sodium, which afforded 8.509 g of residue, the analysis of which was consistent with the results obtained in Run A.

Run C:

To stirred liquid ammonia (1.5 l) in a cylindrical Pyrex reactor were added alternately and in two increments Composition B (20.09 g total ) and sodium metal (20.20 g total), the first increment of the Composition B being treated with small portions of sodium until an end-point was reached before adding the second increment of Composition B and again treating the solution with sodium to an end-point. The solution of Composition B was dark cranberry red initially, which made it difficult to observe the classic blue color associated with solvated electrons. The solution turned a thick chocolate brown as sodium was added, and toward the end of each incremental addition, small floating black flakes were observed. Consequently, in adding the sodium, a piece at a time was stuck to the end of a long glass rod and submerged near the interior surface of the reactor. Black, almost oil-like swirls ultimately came from the sodium and floated to the surface. The black, oil-like substance floating to the surface was taken as indicating the end-point constituting complete reaction. The increments of the Composition B and the sodium added to achieve complete reaction were as follows:

TABLE 7

| Comp. B Increment (g) | Sodium Increment (g) |
|---|---|
| 9.948 | 9.959 |
| 10.138 | 10.239 |

The thick, dark brown, viscous residue, after ammonia evaporation, weighed 61.3 g, and had a strong amine odor.

Run D:

To ammonia (6 1) in a stirred cylindrical Pyrex reactor were added alternately and in eight increments Composition B (81.9 g total) and sodium (63.7 g total), each increment of Composition B being reacted with an increment of sodium to the end-point as described for Run C. The following results were obtained:

TABLE 8

| Comp. B Increment (g) | Sodium Increment (g) |
|---|---|
| 10.510 | 10.852 |
| 10.230 | 9.369 |
| 10.254 | 10.032 |
| 10.403 | 9.484 |
| 9.992 | 9.721 |
| 10.202 | 5.643 |
| 10.312 | 4.880 |
| 9.971 | 3.745 |

Until the last three additions there was a relatively constant ratio of the weight of sodium to the weight of Composition B required to reach the end-point. A linear regression of the data for the first five increments yielded (weight of sodium)/(weight of Composition B) equal to 0.95. The weight of the residue, after ammonia evaporation, was 310 g, which is greater than the combined weight of the Composition B and sodium utilized, perhaps as a result of some residual ammonia, moisture or carbon dioxide absorption.

Run E:

Run D was repeated through six incremental additions of Composition B and sufficient sodium to reach the end point. The following results were obtained:

TABLE 9

| Comp B Increment (g) | Sodium Increment (g) |
|---|---|
| 10.330 | 9.923 |
| 10.211 | 9.561 |
| 10.551 | 10.219 |
| 10.219 | 11.306 |
| 9.939 | 10.051 |
| 9.811 | 6.411 |

Through five incremental additions the weight ratio was essentially constant, falling off somewhat with the sixth addition. Linear regression analysis of the first five increments again yielded 0.95 as the ratio of the sodium weight to the Composition B weight needed to reach the end-point. At the end of the six incremental additions isopropanol (20 ml) was added to ensure there was no unreacted sodium, and the ammonia and alcohol were allowed to evaporate under an argon gas stream to avoid moisture pickup. The bottom of the reactor was heated with a heating tape to assist evaporation, but the temperature of the glass reactor beneath the tape did not exceed 20° C. After approximately 2 hours no additional bubbles were observed in the residue, and the reactor was covered with plastic and an argon gas stream directed across the residue for 14 hours. The viscous fluid residue was then removed from the reactor under argon and weighed 165 g. The residue was completely soluble in water. Analysis of the residue by HPLC showed the absence of any of the compounds listed in Tables 4 and 5. The nitrite and nitrate levels in the residue were found to be 5,147 $\mu$g/g and 249 $\mu$g/g, respectively. NMR spectra of the residue taken in $D_2O$ showed that no EM remained in either air-dried or heated samples of the residue.

EXAMPLE 5

Destruction of M-28 Propellant

M-28 propellant was obtained from Geomet Technologies, Inc. of Gaithersburg, Md. USA in the form of grains from which small pieces and flakes were chipped. It was noted in Run A (see below) that the M-28 did not readily dissolve in liquid ammonia, so in later runs the M-28 was reduced to a size approximating sawdust by filing the as-received grains. The resulting orange filings had a fibrous consistency.

Run A:

To a 1 l flask containing stirred liquid ammonia (400 ml) was added M-28 (1.006 g in the form of small pieces and flakes chipped from the as-received grain) followed by sodium (1.137 g) portion-wise. The M-28 was in the form of particles less than 1 cm in size, but it dissolved only very slowly in the ammonia. After 2 hours and 15 min. the sodium had all been added. The residue (3.950 g), remaining after evaporation of the ammonia was a mixture of a soft, sticky paste and a few hard pieces. The paste dissolved readily in water but the hard pieces, believed to be unreacted M-28, did not.

Run B:

Into a large cylindrical Pyrex reactor provided with stirring was added liquid ammonia (6 l) followed by the alternate and incremental addition of sawdust-sized, orange M-28 propellant (97.88 g) and sodium metal (97.86 g). The M-28 was added in increments of about 10 g each. The sodium was cut into small pieces and added in about 2 g pieces until the sustained blue color indicative of solvated electrons was observed. It was not attempted to sustain the blue color with sodium after each M-28 addition but just to add the M-28 and sodium metal in relatively equal amounts during the course of the run until a blue-black color was observed. The ten incremental steps are shown in the following Table:

TABLE 10

| M-28 Increment (g) | Sodium Increment (g) |
|---|---|
| 9.922 | 11.215 |
| 9.706 | 6.627 |
| 9.848 | 6.844 |
| 9.929 | 4.745 |
| 9.747 | 6.113 |
| 9.785 | 6.734 |
| 9.778 | 4.364 |
| 9.610 | 10.571 |
| 9.685 | 5.514 |
| 9.867 | 17.290 |

Qualitatively, upon addition of the M-28 to the liquid ammonia the ammoniacal solution turned yellow-orange, indicating at least some dissolution of the finely divided M-28. As sodium was added the solution turned purple, then gradually yellow, and finally blue. The blue color gradually turned to green and back to yellow when the solution was allowed to stand, suggesting that the M-28 was still slowly dissolving. A graph of sodium added versus M-28 added yielded a fairly straight line (except for the last point), linear regression analysis yielding a slope of 0.64 g sodium per gram of M-28. The solution was quite viscous at the conclusion of the run. The ammonia was allowed to evaporate from the reactor, which had been covered with a plastic film. A steam of helium was led into the reactor to exclude ambient air. After 17 hours the residue in the reactor had the appearance of drying mud; it had a strong amine odor. The helium flow was continued over another night. The next morning it was observed that the plastic film had been destroyed, and the M-28 residue was a dry, black carbonaceous material which had a charcoal-like odor. It was surmised that excess sodium had been present, the addition of isopropanol to quench any unreacted sodium had inadvertently been omitted, and residual sodium had reacted with water which had condensed into the cold reactor.

Run C:

Run B was repeated, except that the total amount of M-28 was limited to about 50 g in 5 increments as follows:

TABLE 11

| M-28 Increment (g) | Sodium Increment (g) |
|---|---|
| 9.927 | 10.955 |
| 9.894 | 5.953 |
| 9.930 | 5.616 |
| 9.846 | 5.992 |
| 9.521 | 6.302 |

The data plotted as a nearly straight line with a calculated slope of 0.60 g sodium per gram of M-28. Upon completion of the reaction the ammonia was allowed to evaporate under an argon gas stream, about 20 ml of isopropanol being added to ensure there was no unreacted sodium. A heating tape was wrapped around the bottom of the reactor, but care was taken that the temperature indicated by a thermocouple between the tape and the reactor never exceeded 20° C. After approximately 2 hours the ammonia was almost completely evaporated as evidenced by the absence of bubbles in the viscous residual material. The reactor was covered with a plastic film and argon allowed to flow over the surface of the residue for another 14 hours, following which the residue was scraped from the reactor with a rubber spatula and transferred to a tared beaker under argon. The residue weighed 165 g, considerably more than the sum of the weights of the M-28 and sodium reactants. HPLC analysis of the residue failed to detect any of the compounds set forth in Tables 4 and 6. The levels of nitrite and nitrate were 9092 μg/g and 5895 μg/g, respectively. The amount of nitrocellulose in the residue was <100 μg/g. NMR ($^1$H) spectra of the residue in $D_2O$ failed to detect either starting material or recognizable products, and the infrared spectra were similarly devoid of definitive identifications. The impact sensitivity of the residue was greater than 132 J (97 ft-lb), the limit of the apparatus. For comparison, the impact sensitivity of M-28 was 18 J (13 ft-lb). No indication of reaction was noted in testing the residue for thermal stability. The sliding friction test applied to both the M-28 starting material and the M-28 residue led to reaction in the case of the M-28 starting material but not the product residue. Surprisingly, in the electrostatic ignition test, the minimum ignition energy of the product residue was 10 mJ, whereas the minimum ignition energy of the M-28 starting material in the same test was 175 mJ; the reasons for this are not understood. In the small scale burning test, the M-28 residue burned without explosion or detonation.

Run D:

Run C was repeated with the following increments:

TABLE 12

| M-28 Increment (g) | Sodium Increment (g) |
|---|---|
| 10.003 | 6.226 |
| 10.020 | 6.231 |
| 9.911 | 5.539 |
| 9.894 | 4.819 |
| 9.351 | 5.474 |

The graph of these data produced a nearly straight line with a slope of 0.51 g sodium per gram of M-28. It is speculated that the lower slope in this and the next run may have been due to a change in the tank of ammonia being employed.

Run E:

Run C was repeated with the following increments:

TABLE 13

| M-28 Increment (g) | Sodium Increment (g) |
|---|---|
| 9.398 | 6.187 |
| 9.305 | 3.386 |
| 7.773 | 4.355 |
| 9.316 | 5.623 |
| 9.237 | 4.852 |

These data when graphed yielded a nearly straight line with a slope of 0.55 g sodium per gram of M-28 propellant.

EXAMPLE 6

Treatment of Soil Contaminated With TNT

A soil contaminated with TNT is prepared by adding to a 500 ml beaker a representative soil (125 g), namely Ohio loam having an analysis of 35% sand, 32% silt and 33% clay by weight, with a pH of 7.7. A solution of TNT (1.0 g) in acetone (about 100 ml) is prepared and added to the beaker. The contents of the beaker are vigorously stirred, poured into a large crystallizing dish and allowed to dry overnight at room temperature, following which the contaminated soil residue remaining in the dish is homogenized by crushing and mechanical mixing with a spatula. A representative 10 g sample of the contaminated soil is extracted with acetone (about 100 ml), and the extract is evaporated under vacuum to a residue (80 mg, mp 75–80° C.). The IR and NMR spectra of the residue are consistent with the presence of TNT. A second 10 g sample of the contaminated soil is slurried in a beaker with a solution of 200 ml of a blue-colored solution of liquid ammonia to which has been added metallic sodium (3 g). Following evaporation of the ammonia, the residue is extracted with acetone (about 100 ml) as before, and the acetone is removed from the extract under vacuum, affording a residue (90 mg, oil). The IR and NMR spectra of the oily residue fail to detect the presence of TNT.

EXAMPLE 7

Destruction of a Mixture of Composition B and Sarin

This experiment is carried out within a vented hood in a stainless steel, pressurizable reaction vessel equipped with external cooling and having an internal volume of approximately 2 liters. The vessel is equipped with mechanical stirring, a removable sight glass port, a thermometer port, an inlet port connected to a high performance liquid chromatography pump which is used to add the Sarin from an external container, and a port in the vessel headspace for a pressure gauge. The reaction vessel also contains a port through which the nitrogenous base is pumped into the reaction vessel and a drain port at the bottom of the reaction vessel for product recovery.

Anhydrous liquid ammonia (1.6 l) is added to the reaction vessel, the temperature of the vessel's contents being controlled at about −40° C. with external cooling. With stirring, Sarin (10.5 g) is pumped into the reaction vessel and dissolved in the ammonia, followed by Composition B (1.0 g) added as small pieces through the temporarily removed sight port. Sodium metal (16.5 g total) is added in small pieces periodically through the sight port slowly so as to maintain the temperature of the reaction mixture no higher than about −20° C. The blue color associated with the presence of solvated electrons is observed from time to time as the sodium is added to the solution and is persistent as the sodium addition is concluded.

Following completion of the sodium addition, the contents of the vessel are drained. The ammonia is allowed to evaporate in the hood, leaving a solid residue. The residue is analyzed for residual Sarin using the cholinesterase inhibition test and for residual Composition B by NMR and IR spectroscopy. Neither Sarin nor Composition B are detected in the residue.

EXAMPLE 8

Destruction of Lead Azide

Liquid ammonia (800 ml) is added to a 1 l flask. Lead azide powder (total 2.0 g) and sodium metal (total 0.86 g) are added alternately and portion-wise to the stirred contents of the flask, resulting in a hazy blue colored solution containing finely divided particulate matter. The stirring is suspended, whereupon the solution clears and a gray precipitate is deposited on the bottom of the flask. The supernatant ammoniacal liquid is decanted and separated from the gray precipitate. The precipitate is treated with isopropanol (20 ml) and then washed several times with warm water, the wash water being separated from the heavy solid by decantation. The solid is transferred to a tared crystallizing dish and allowed to dry overnight, affording a light gray solid (1.36 g). The solid, while insoluble in water, acetone and benzene, dissolves in nitric acid. The solid is not impact-sensitive up to the limit of the apparatus, 132 J (97 ft-lb). The solid is identified as lead on the basis of its emission spectrum.

EXAMPLE 9

Destruction of Ammonium Nitrate

To a stirred 1 l flask is added anhydrous liquid ammonia (750 ml), followed by ammonium nitrate (10 g, 0.13 mole) added all at once. To the resultant mixture is added sodium metal (3.1 g, 0.14 mole) in small increments, leading transiently to the blue color associated with solvated electrons and, finally, to a persistent blue color, signaling the end point. Thus, the stoichiometry appears to be 1:1, a result which is consistent with the reaction:

$$\text{(V)}\ NH_4NO_3+Na \rightarrow NaNO_3+NH_3+\tfrac{1}{2}H_2$$

Destruction of the ionically bonded ammonium salt requires one mole of active metal per mole of reactant salt, rather than the two moles of active metal required to destroy covalently bonded compounds.

EXAMPLE 10

Destruction of Glycerol Trinitrate

Glycerol trinitrate (1.5 g, 0.007 mole) is added to a stirred 1 l flask containing anhydrous liquid ammonia (650 ml). To the resultant mixture is added sodium metal (2.8 g, 0.12 mole) in small increments. As the sodium is added, whisps of blue are transiently produced in the solution, the blue color persisting throughout the solution for 5 min. as the last of the sodium is introduced. The ammonia is allowed to evaporate from the flask, leaving a sticky light gray residue which is readily dissolved in water. HPLC analysis fails to detect glycerol trinitrate in the residue.

The aforesaid Examples illustrate the method of this invention carried out on individual batches of EM or EM/CWA. The process of this invention can also be carried out continuously or batch-wise in a reactor system such as that described in earlier application PCT/US96/16303, filed Oct. 10, 1996 and incorporated herein by reference. Such a reactor system can be operated in either a batch-wise mode or continuously. The earlier described reactor system is illustrated diagramatically in FIG. 1.

With reference now to FIG. 1, reactor system 10 includes a number of hardware components, including reaction vessel 20 which is equipped with a heating/cooling jacket if desired and various monitors of temperature, pressure, and so forth, and is adapted to receive a solution of solvated electrons from solvator 30 and EM or EM/CWA from storage vessel 40. It will be evident that in the event the EM or EM/CWA is a solid, pump 41 can be replaced with an appropriate solids feeder, such as a screw-fed extruder, if desired. The reactor system also incorporates condenser 50, decanter 60, dissolver 70, oxidizer 80, which is an optional component, and off gas treatment module 90, which is also an optional component. The reactor system is equipped with the auxiliary equipment necessary to control the temperature and the pressure in the various components of the system as necessary to carry out the EM or EM/CWA destruction under the desired values of those parameters. Many variations for each of the aforesaid hardware elements are available commercially, permitting a skilled engineer to select the optimum components for the job at hand.

Although the reactor system shown in FIG. 1 is specifically directed to the situation in which the EM or EM/CWA is available in bulk quantities for transfer into reaction vessel 20 from EM or EM/CWA storage vessel 40, it will be evident that reaction vessel 20 can be sized and access provided, if desired, to accommodate native containers of EM or EM/CWA, in which event storage vessel 40 and associated lines and equipment will be unnecessary. It may also be desirable to separate the empty native containers from product stream 26 prior to further processing of the product stream.

The batch-wise operation of reactor system 10 can be carried out in a manner similar to that described above in connection with the aforesaid Examples 1–10. However, reactor system 10 can also be utilized in practicing the method continuously.

Operated continuously, the method comprises providing a reactor system which includes (1) a reaction vessel to receive the EM or EM/CWA from storage, (2) a solvator containing nitrogenous base in which to dissolve active metal, producing a solution of solvated electrons, (3) a condenser for treating gas evolved from the reaction vessel, (4) a decanter to receive reaction products from the reaction vessel and separate the reaction products into a liquid fraction and a solid fraction, and (5) a dissolver for contacting the solid fraction with water to produce a fluid mixture; continuously charging the solvator with nitrogenous base and active metal; continuously introducing the solution of solvated electrons into the reaction vessel; continuously introducing EM or EM/CWA into the reaction vessel; continuously and optionally recovering nitrogenous base from the evolved gas and introducing the recovered nitrogeneous base into the solvator as makeup or the reaction vessel as reflux; continuously receiving reaction products in the decanter and continuously separating the reaction products into a solid fraction and a liquid fraction; continuously introducing liquid fraction into the solvator as makeup; and continuously contacting the solid fraction with water in the dissolver, producing a fluid mixture for optional further treatment.

EXAMPLE 11

Continuous Destruction of Glycerol Trinitrate

With reference to FIG. 1, solvator 30 is charged continuously with anhydrous liquid ammonia (stream 31) and pelletized sodium metal as stream 33, the ratio of sodium/liquid ammonia being maintained at about 1 part sodium/250 parts liquid ammonia by weight. Glycerol trinitrate and liquid ammonia are continuously added to storage vessel 40, producing a solution which contains about 1 part glycerol trinitrate/500 parts liquid ammonia by weight. The contents of solvator 30 are continuously added to reaction vessel 20 as stream 32, and the contents of storage vessel 40 are continuously pumped into reaction vessel 20 as stream 42. The relative flow rates of streams 32/42 are maintained at approximately 1/1 by weight. The temperature of the mixture in reaction vessel 20 is controlled so that the liquid ammonia and any condensible gaseous glycerol trinitrate destruction products pass as stream 25 into condenser 50 wherein the condensible gas, e.g., ammonia, is condensed, and at least a portion of that condensate is optionally returned to the reaction vessel as reflux stream 52. Another portion of the condensate is optionally tapped as stream 53 which is returned, optionally using pump 51, to the solvator 30 as makeup nitrogenous base.

Any noncondensed gas leaving condenser 50 is optionally treated in off gas treatment module 90 using, e.g., scrubber technology, to separate any gases which are innocuous for venting as stream 91 and leading any toxic gases, or scrubber solutions containing them, to dissolver 70 as stream 97.

Meanwhile, product-containing reaction mixture is continuously withdrawn from reaction vessel 20 and led as stream 26 to decanter 60 where the reaction mixture, to the extent it contains solid reaction product, is continuously decanted, producing a liquid fraction, rich in nitrogenous base, which is fed as stream 63 to solvator 30 as nitrogenous base makeup, and a solid-containing fraction which is fed as stream 67 to dissolver 70.

Water, stream 71, is continuously fed into dissolver 70, wherein the water contacts and dissolves any water soluble component of the solid fraction. The resultant solution can be further purified and sold, if desired, or treated as waste. The material fed to the dissolver which is not soluble in water generally contains byproducts which can be treated as waste or fed back into reaction vessel 20 for reprocessing.

Optionally, one or the other or both the water soluble and the water insoluble components found in dissolver 70 can be fed as stream 78 to oxidation unit 80 for, preferably, chemical oxidation, output stream 81 ideally containing only carbon dioxide, water, and inorganics which can be treated as waste or values recovered therefrom.

Although this invention has been described in terms of specific examples, it is not intended to limit the invention to the specific examples. The invention is to be limited only by the breadth of the following claims.

We claim:

1. A method for destroying an energetic material, which method comprises (A) creating a reaction mixture which includes at least one energetic material and solvated electrons formed from an active metal selected from the group consisting of sodium, potassium, lithium, calcium and mixtures thereof; and (B) reacting said mixture.

2. The method of claim 1 wherein said reaction mixture is created by combining raw materials which include:

(1) nitrogenous base;

(2) at least one energetic material; and the (3) active metal in an amount sufficient to destroy the energetic material.

3. The method of claim 2 wherein the active metal is added incrementally as a solid.

4. The method of claim 2 wherein the molar amount of the active metal is at least twice the molar amount of the energetic material.

5. The method of claim 2 wherein the nitrogenous base is selected from the group consisting of ammonia, amines and mixtures thereof.

6. The method of claim 5 wherein the amines are selected from the group consisting of methylamine, ethylamine, propylamine, isopropylamine, butylamine, and ethylenediamine.

7. The method of claim 5 wherein the nitrogenous base is ammonia.

8. The method of claim 1 wherein the reaction mixture is blue in color.

9. The method of claim 1 wherein said energetic material is in its native container and the reaction mixture is created in said native container.

10. The method of claim 1 wherein said energetic material is present as a soil contaminant.

11. The method of claim 1 wherein the energetic material is selected from the group consisting of explosives, propellants and pyrotechnics.

12. The method of claim 1 wherein the energetic material is selected from the group consisting of explosives and propellants.

13. The method of claim 1 wherein the energetic material is selected from the group consisting of lead azide, mercury fulminate, 4,5-dinitrobenzene-2-diazo-1-oxide, lead staphnate, guanyldiazoguanyltetracene, potassium dinitrobenzofuroxane, lead mononitroresorcinate, 1,2,4-butanetriol trinitrate, diethyleneglycol dinitrate, nitrocellulose, nitroglycerin, nitrostarch, pentaerythritol tetranitrate, triethyleneglycol dinitrate, 1,1,1-trimethylolethane trinitrate, cyclotetramethylenetetranitramine, cyclotrimethylenetrinitramine, ethylenediamine dinitrate, ethylenedinitamine, nitroguanine, 2,4,6-trinitrophenylmethylnitramine, ammonium 2,4,6-trinitrophenolate, 1,3-diamino-2,4,6-trinitrobenzene, 2,2',4,4',6,6'-hexanitroazobenzene, hexanitrostilbene, 1,3,5-triamino-2,4,6-trinitrobenzene, 2,4,6-trinitrotoluene, ammonium nitrate, and mixtures thereof.

14. The method of claim 1 wherein the energetic material is selected from the group consisting of nitrocellulose, cyclotrimethylenetrinitramine, 2,4,6-trinitrotoluene, and mixtures thereof.

15. The method of claim 1 wherein the active metal is sodium.

16. A method for destroying an energetic material, which method comprises (A) creating a reaction mixture from raw materials which include:

(1) nitrogenous base selected from the group consisting of ammonia, amines and mixtures thereof;

(2) at least one energetic material selected from the group consisting of lead azide, mercury fulminate, 4,5-dinitrobenzene-2-diazo-1-oxide, lead staphnate, guanyldiazoguanyltetracene, potassium dinitrobenzofuroxane, lead mononitroresorcinate, 1,2,4-butanetriol trinitrate, diethyleneglycol dinitrate, nitrocellulose, nitroglycerin, nitrostarch, pentaerythritol tetranitrate, triethyleneglycol dinitrate, 1,1,1-trimethylolethane trinitrate, cyclotetramethylenetetranitramine, cyclotrimethylenetrinitramine, ethylenediamine dinitrate, ethylenedinitamine, nitroguanine, 2,4,6-trinitrophenylmethylnitramine, ammonium 2,4,6-trinitrophenolate, 1,3-diamino-2,4,6-trinitrobenzene, 2,2',4,4',6,6'-hexanitroazobenzene hexanitroazobenzene, hexanitrostilbene, 1,3,5-triamino-2,4,6-trinitrobenzene, 2,4,6-trinitrotoluene, ammonium nitrate, and mixtures thereof; and (3) active metal to form solvated electrons selected from the group consisting of lithium, sodium, potassium, calcium, and mixtures thereof in an amount sufficient to destroy the energetic material; and (B) reacting said mixture.

17. A method for destroying an energetic material, which method comprises:

(A) providing a reactor system which includes (1) a reaction vessel to receive the energetic material;

(2) a solvator containing nitrogenous base in which to dissolve active metal to form solvated electrons;

(3) a condenser for treating gas evolved from the reaction vessel;

(4) a decanter to receive reaction products from the reaction vessel and separate the reaction products into a liquid fraction and a solid fraction; and (5) a dissolver for contacting the solid fraction with water to produce a fluid mixture;

(B) continuously charging the solvator with nitrogenous base and active metal;

(C) continuously introducing energetic material into the reaction vessel;

(D) continuously recovering nitrogenous base from the evolved gas and introducing the recovered nitrogenous base into the solvator as makeup;

(E) continuously receiving reaction products in the decanter and continuously separating the reaction products into a solid fraction and a liquid fraction;

(F) continuously introducing liquid fraction into the solvator as makeup, and (G) continuously contacting the solid fraction with water in the dissolver, producing the fluid mixture.

18. A method for destroying a combination of at least one energetic material and at least one chemical warfare agent, which method comprises (A) creating a reaction mixture which includes said combination and solvated electrons prepared from an active metal selected from the group consisting of sodium, potassium, lithium, calcium and mixtures thereof; and (B) reacting said mixture.

19. The method of claim 18 wherein said reaction mixture is created by combining raw materials which include:

(1) nitrogenous base;

(2) at least one energetic material;

(3) at least one chemical warfare agent; and (4) the active metal in an amount sufficient to destroy the energetic material and the chemical warfare agent.

20. The method of claim 19 wherein the energetic material is selected from the group consisting of lead azide, mercury fulminate, 4,5-dinitrobenzene-2-diazo-1-oxide, lead staphnate, guanyldiazoguanyltetracene, potassium dinitrobenzofuroxane, lead mononitroresorcinate, 1,2,4-butanetriol trinitrate, diethyleneglycol dinitrate, nitocellulose, nitroglycerin, nitrostarch, pentaerythritol tetranitrate, triethyleneglycol dinitrate, 1,1,1-trimethylolethane trinitrate, cyclotetramethylenetetranitramine, cyclotrimethylenetrinitramine, ethylenediamine dinitrate, ethylenedinitamine, nitroguanine, 2,4,6-trinitrophenylmethylnitramine, ammonium 2,4,6-trinitrophenolate, 1,3-diamino-2,4,6-trinitrobenzene, 2,2',4,4',6,6'-hexanitroazobenzene, hexanitrostilbene, 1,3,5-triamino-2,4,6-trinitrobenzene, 2,4,6-trinitrotoluene, ammonium nitrate, and mixtures thereof.

21. The method of claim 19 wherein the chemical warfare agent is selected from the group consisting of vesicants, nerve agents, and mixtures thereof, the formula of said vesicants containing at least one group of the formula:

(III)

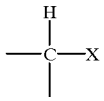

in which X is halogen; said nerve agents being represented by the formula:

(IV)

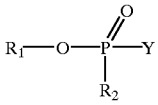

in which $R_1$ is alkyl, $R_2$ is selected from alkyl and amino, and Y is a leaving group.

22. The method of claim 21 wherein X in formula (III) is selected from fluorine, chlorine and bromine and Y in formula (IV) is selected from halogen, nitrile and sulfide.

23. The method of claim 21 wherein the chemical warfare agent is selcted from the group consisting of mustard gas, Lewisite, Tabun, Sarin, Soman, VX, and mixtures thereof.

* * * * *